US006367641B1

(12) United States Patent
Garcia et al.

(10) Patent No.: US 6,367,641 B1
(45) Date of Patent: Apr. 9, 2002

(54) DISPENSING DEVICE WITH SAFE UNSCREWING

(76) Inventors: Firmin Garcia, 47, avenue Aristide Briand, F-27000 Evreux (FR); Denis Croibier, Berrou la Mulotiere, F-28270 Brezolles (FR)

( * ) Notice: Subject to any disclaimer, the term of this patent is extended or adjusted under 35 U.S.C. 154(b) by 0 days.

(21) Appl. No.: 09/341,338

(22) PCT Filed: Jan. 7, 1998

(86) PCT No.: PCT/FR98/00021

§ 371 Date: Oct. 4, 1999

§ 102(e) Date: Oct. 4, 1999

(87) PCT Pub. No.: WO98/30464

PCT Pub. Date: Jul. 16, 1998

(30) Foreign Application Priority Data

Jan. 10, 1997 (FR) ..... 97 00187

(51) Int. Cl.[7] ..... B65D 41/34
(52) U.S. Cl. ..... 215/330; 222/153.09
(58) Field of Search ..... 222/153.09, 153.1; 215/330

(56) References Cited

U.S. PATENT DOCUMENTS

| | | | | |
|---|---|---|---|---|
| 2,423,582 A | | 7/1947 | Coleman | |
| 3,977,557 A | | 8/1976 | Hazard | |
| 4,345,691 A | | 8/1982 | Burke | |
| 5,000,332 A | | 3/1991 | Whitacre | |
| 5,238,152 A | * | 8/1993 | Maas et al. | 222/153.09 |

* cited by examiner

*Primary Examiner*—Philippe Derakshani
(74) *Attorney, Agent, or Firm*—Rockey, Milnamow & Katz, Ltd.

(57) ABSTRACT

The invention concerns a device for dispensing a fluid product designed for being screwed on a threaded neck of a fluid product reservoir, the device including a threaded fixing element for being in threaded engagement with the threaded neck of the reservoir for fixing the dispensing device on the reservoir neck. The invention is characterized in that a unidirectional driving member is provided covering the fixing element so as to prevent any access to the fixing element when it is screwed on the reservoir neck, such that the fixing element cannot be unscrewed by rotation of the unidirectional driving member.

11 Claims, 2 Drawing Sheets

DISPENSING DEVICE WITH SAFE UNSCREWING

BACKGROUND OF THE INVENTION

The present invention relates to a device for dispensing a fluid product, which is intended to be screwed on a threaded neck of a container of a fluid product. Dispensing device should be understood to mean any devices of the pump or valve type capable of dispensing a fluid product in the form of measured quantities or a continuously sprayed stream. In general, this type of dispensing device, which is generally manual, is used in the cosmetic, pharmaceutical and perfumery realm for dispensing in measured or continuous form a fluid product which is stored in a container.

The present invention more particularly relates to a device which has a threaded fastening element, such as a ring fastener, which is intended to engage with the threaded neck of the container in order to bring about a sealed fastening of the dispensing device to the neck of the container. Screwing is one of the means frequently used to fasten a pump or a valve on a container neck. The invention applies therefore to a screw-on dispensing device and more specifically relates to a safety or security device to prevent improper use or illicit opening of the container by removal of the dispensing device to which it is screwed.

There are already in the prior art various types of security or safety devices intended to ensure that the user is the first to use the dispenser. In particular, there are known actuation safety devices in the form of a cord which connects the actuation head of the dispensing device to its ring fastener in order to prevent actuation of the dispenser by pressing on its push button. Actuation of the device is then possible only after withdrawal of the cord, which is torn off manually by breaking bridges of breakable material which connect the actuation head to the ring fastener.

Also known in the prior art is a document U.S. Pat. No. 4,345,691 which describes a safety closing device in which an interior threaded ring is given inclined teeth suitable for cooperating with notches formed on the periphery of the neck of the container. Because the teeth are all inclined in the same direction, they allow screwing on the ring by sliding the teeth over the notches, but prevent its being unscrewed by stopping the crests of the teeth against the notches of the neck.

With this device, not only is the ring of a special type, since it has teeth, but so also is the neck of the container which is formed with notches. This type of device therefore cannot be used with just any type of container.

The documents U.S. Pat. No. 3,977,557 and U.S. Pat. No. 2,423,582 relate to devices in which a cap is screwed in an non-reversible manner onto the neck of the container.

SUMMARY OF THE INVENTION

The present invention relates to another type of first-use safety or security device which is also provided for dispensing devices which are screwed on any container. In effect, the present invention relates to a device for dispensing a fluid product, which is intended to be screwed on a threaded neck of a container of fluid product, said device having a threaded fastening element intended to engage with the threaded neck of the container in order to fast the dispensing device to the neck of the container, a screwing-on unidirection-moving component driving component, or actuating component being provided which covers the fastening element so as to prevent any access to the fastening element when the latter is screwed onto the neck of the container, and which allows movement of the fastening element only in the direction which ensures its screwing onto the neck of the container, so that the fastening element cannot be unscrewed from the neck by rotation of the screwing-on direction-moving component. The screwing-on direction-moving component thus fulfills a dual function: first, that of making the threaded fastening element inaccessible, and second, that of allowing movement of the threaded fastening element only in the screwing-on direction by rotation in the same direction. Thus, once the threaded fastening element is screwed onto the neck, it is impossible to unscrew it from the neck by rotation in the reverse direction of the unidirectional moving component.

It should be noted that this irreversible fastening system can be used on any type of container, given that the impossibility of unscrewing the ring does not come from cooperation between the neck and the ring but, on the contrary, from cooperation between the ring and the moving component.

According to an advantageous form of execution, an exterior surface of the fastening element cooperates with an interior surface of the moving component in order to allow movement of the fastening component only in the screwing-on direction by rotation of the moving component.

According to an advantageous embodiment, the fastening element is an essentially cylindrical ring, said ring having an exterior surface with at least one essentially flexible tab, extending towards the exterior in an inclined manner with respect to the radial direction, with the free end of the tab pointing in the direction opposite the direction ensuring screwing on and the unidirectional actuating component (i.e., moving component or driving component) is an essentially cylindrical hoop which has an interior surface with a number of stops corresponding to the number of tabs in order to receive and block the free ends of the tabs when the hoop is rotated in the screwing-on direction. The tab or tabs must be inclined and have resiliency such that they remain completely rigid when they come up against the stops and such that they bend when they pass over the stops when the moving component is turned in the direction opposite that ensuring screwing on. Advantageously, the tabs are adapted so as to bend above a predetermined value of tightening torque.

As a variant, the fastening element is an essentially cylindrical ring, said ring having an exterior surface with at least one essentially rigid tab, extending towards the exterior in an inclined manner with respect to the radial direction, with the free end of the tab pointing in the direction opposite that ensuring screwing on, and the undirectional actuating component is an essentially cylindrical hoop, which has an interior surface with a number of stops corresponding to the number of tabs in order to receive and block the free ends of the tabs when the hoop is rotated in the screwing-on direction. Advantageously, the tabs are adapted so as to break above a predetermined value of tightening torque.

The invention will now be described with reference to the accompanying drawings, giving an embodiment of the present invention as a non-limiting example.

DETAILED DESCRIPTION OF THE PREFERRED EMBODIMENTS

Figure 1:
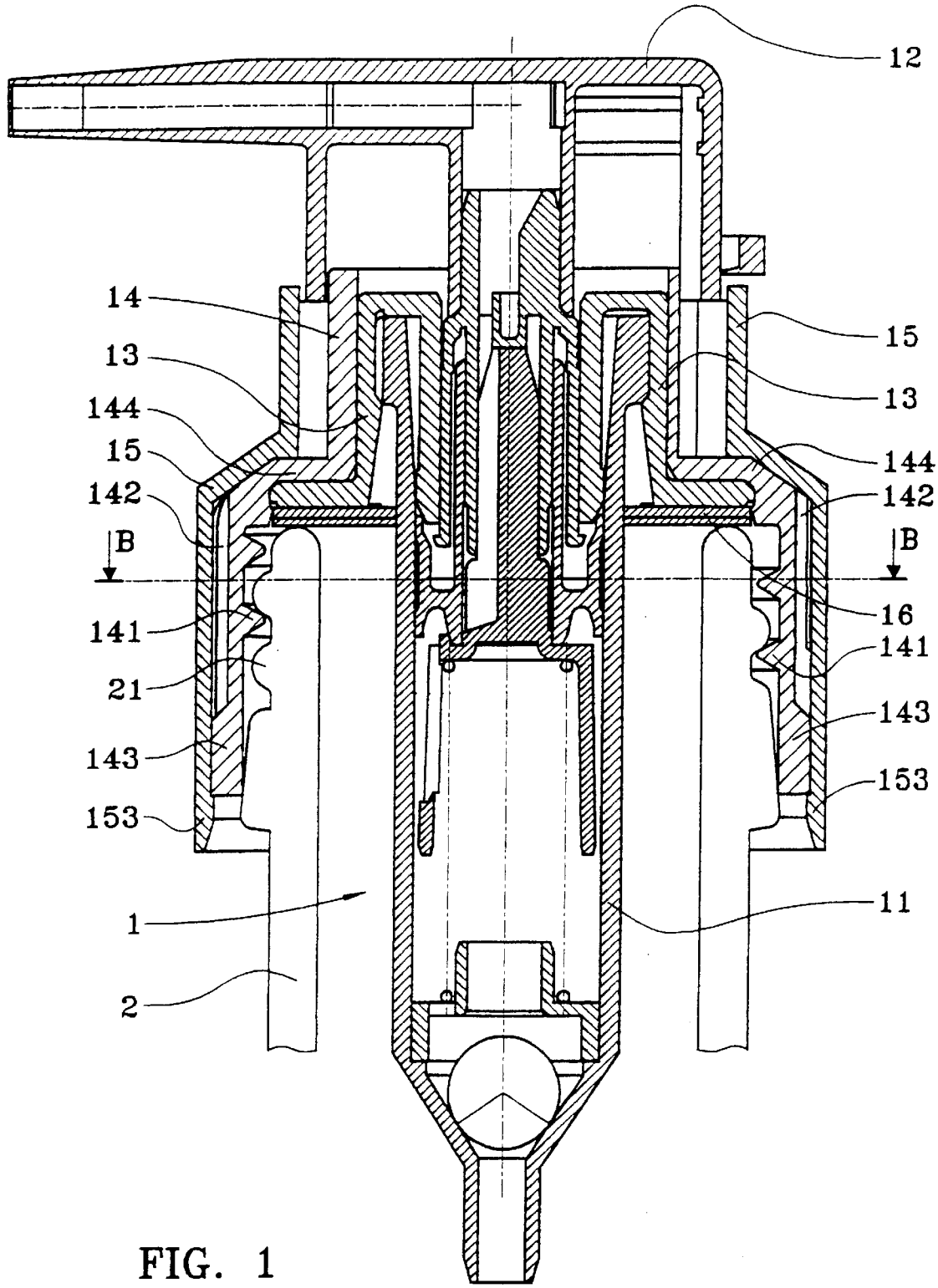
FIG. 1 represents a vertical section through a dispensing device according to the invention which is screwed onto a container neck.

The dispensing device according to the invention represented in FIG. 1 is a precompression-type pump which has pump body 11 in which a piston is mounted so as to slide. The piston is attached to a hollow actuating rod to which push button 12, provided with an outlet nozzle, is connected. The particular type of dispensing device is not essential for the invention. In effect, it is equally possible to use a valve that measures out or one that does not in order to illustrate an embodiment which incorporates the present invention. This is why the type of dispensing device must not be considered as the only type which can be used with the present invention.

In this case, the pump represented in FIG. 1 is mounted on neck 2 of a container whose exterior end surface is provided with threads 21. To fasten the pump on neck 2 of the container, a small tower or fitting 13 is provided, which forms an internal housing in which the upper end of pump body 11 is force fit. Small tower 13 has a flange which extends radially towards the exterior with an exterior diameter which is essentially equal to the diameter of neck 2. In order to effect sealing between the small tower 13 and the upper end of neck 2, seal 16 is provided, which is interposed between the radial flange of small tower 13 and the upper end of neck 2. Furthermore, for actual connection of the dispensing device to threaded neck 2 of the container, ring fastener 14 is provided, which is mounted around small tower 13 and whose interior surface is provided with threads 141 with a pitch matched to that of threads 21 of neck 2. In order to make possible the crushing of seal 16 on the upper end of neck 2, ring 14 also has horizontal flange 144 which presses the corresponding flange of small tower 13 to crush seal 16 by the screwing engagement of threads 141 of ring 14 onto threads 21 of ring 2. Up to now, all the constitutive parts described and their arrangement come under the heading of a completely conventional device of the prior art.

According to the invention, a driving component, moving component or actuating component, such as hoop or sleeve 15, is provided. The hoop 15 covers the whole ring fastener 14 and cooperates with the latter in a unidirectional manner so as to allow movement of ring fastener 14 in the screwing-on direction by rotation of hoop 15 and to prevent the rotational movement of ring fastener 14 by rotation of the hoop in the opposite direction which corresponds to unscrewing. Thus, it is only possible to screw ring fastener 14 onto threaded neck 2 of the container; once ring fastener 14 is screwed on, it is no longer possible to unscrew it. This provides the user with security from improper or fraudulent opening of the container by withdrawal of the dispensing device.

Figure 2:
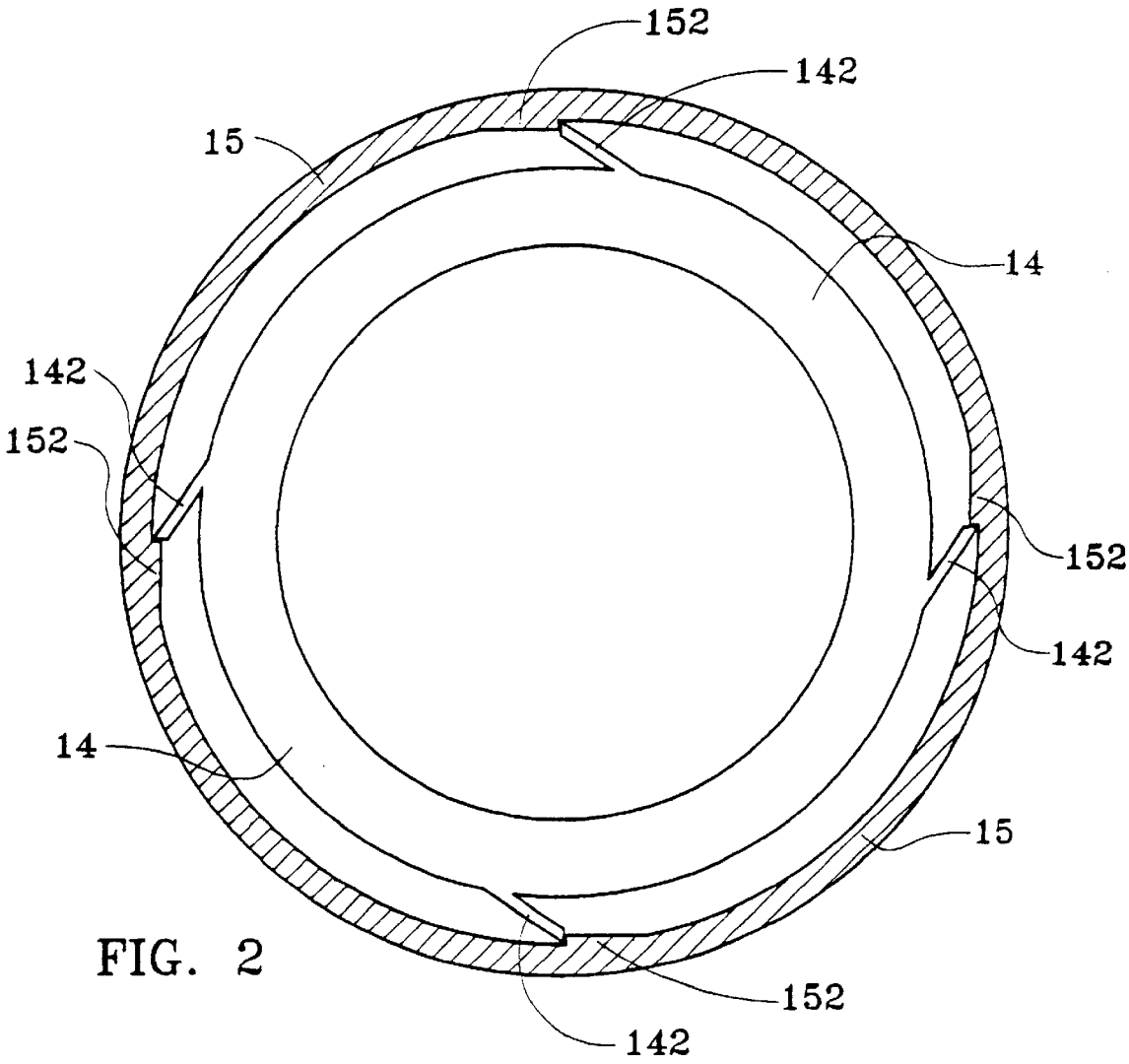
FIG. 2 is a section along the cutting line B—B of FIG. 1 of the dispensing device according to FIG. 1.
Figure 3:
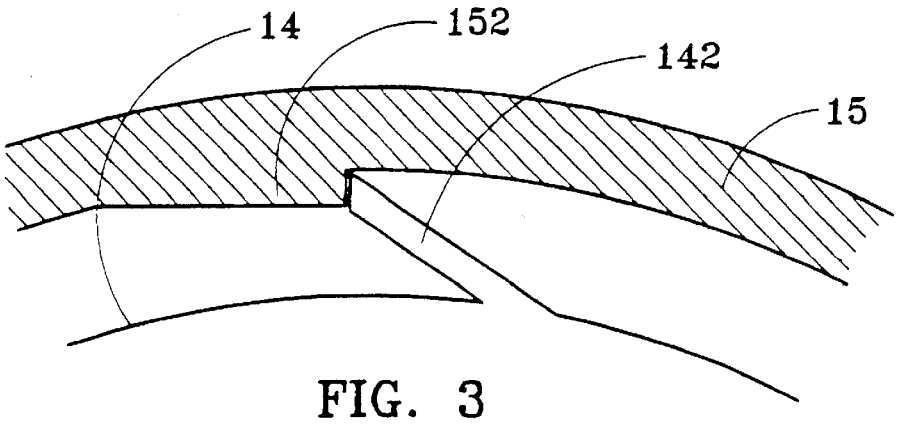
FIG. 3 is an enlarged representation of a detail isolated from FIG. 2.

In reference equally to FIGS. 1, 2 and 3, an execution example will now be described which allows hoop 15 to ensure only unidirectional movement. According to this particular embodiment, the exterior surface of ring fastener 14, for example, at the level of its internal threads 141, is provided with one or more tabs 142, preferably four as represented in FIG. 2. These tabs 142 have a reduced thickness which gives them a certain flexibility. These tabs 142 extend in an inclined manner with respect to the general radial direction of the ring and of the hoop, with the free end of tabs pointing in the direction opposite that for screwing ring fastener 14 onto neck 2. The tabs extend for a certain height, as can be seen in FIG. 1. Tabs 142 extend towards the exterior over a sufficiently long distance so that their free ends come in contact with the interior surface of hoop 15 which covers ring fastener 14.

Furthermore, hoop 15 has an interior surface, situated approximately at the level of tabs 142, which is provided with stops 152 which are oriented in such a way that their stop surfaces block the free ends of tabs 142. For this purpose, stops 152 form a projection or an indentation in the wall of hoop 15, and moreover, tabs 142 of ring fastener 14 have a resiliency such that they remain completely rigid when they come up against stops 152, but can bend, nonetheless, in order to pass over the projection produced by stops 152 when hoop 15 is turned in the W unscrewing direction. The tabs have sufficient resiliency to allow them to support a predetermined torque which ensures securely-tightened screwing of ring 14 onto neck 2. It is seen clearly in FIG. 3, which represents an enlarged view, the manner in which tabs 142 cooperate with stops 152 in order to ensure the unidirectional movement. A completely equivalent embodiment consists of providing tabs inside of hoop 15 and stops on ring fastener 14. In this case, the orientation of the tabs and of the stops would be reversed with respect to the embodiment represented in the figures.

As described above, tabs 142 must support a certain "screwing" torque with a predetermined value. Beyond this value, the tabs bend and pass over their respective stops 152. As a variant, the tabs can be completely rigid so as to break when this torque value is exceeded. As can be seen in FIG. 1, the broken tab pieces cannot come out of the device because they are blocked in the cylindrical housing formed between ring 14 and hoop 15 which is closed by terminal shoulder 143 which is an integral part of ring 14.

Thanks to the invention, it is possible, in a simple manner, using a molded piece of relatively simple design, to provide the user with the security that the container has not been opened, while giving the dispensing device a pleasant aesthetic appearance.

What is claimed is:

1. A device for dispensing a fluid product, the device adapted for screwing onto a threaded neck of a container of fluid product, said device comprising:

a threaded fastening element adapted to be screwed onto the threaded neck of the container; and a driving component covering said fastening element to prevent access to said fastening element when said fastening element is screwed onto the threaded neck, said fastening element and said driving component including an intervening mechanism which allows turning of said driving component to turn said threaded fastening element only in a first rotary direction corresponding to a screwing-on of said threaded fastening element to the threaded neck.

2. The device according to claim 1, wherein said driving component has an interior surface, wherein said fastening element has an exterior surface, and wherein said intervening mechanism is applied between said interior surface of said driving component and said exterior surface of said fastening element.

3. The device according to claim 1 wherein said fastening element comprises a substantially cylindrical ring, said ring having an exterior surface with at least one substantially flexible tab which has a base end, a free end, and which extends outwardly in an inclined manner to the radial direction from said base end at said exterior surface to said free end of the tab, said free end trailing said base end when said driving component is turned in said first rotary direction; and said driving component comprises a substantially cylindrical hoop having a cylindrical interior surface having at least one stop, said stop arranged to receive and block the free end of said tab when said hoop is rotated in said first rotary direction.

4. A device according to claim 3 wherein said tab is adapted to bend when said hoop is turned with a tightening torque above a predetermined value.

5. A device according to claim 3 wherein said tab is one of a plurality of tabs spaced around a circumference of said exterior surface of said cylindrical ring and said stop is one of a plurality of stops spaced around a circumference of said interior surface of said hoop.

6. A device according to claim 3 wherein said tabs are elongated in a direction parallel to an axis of said hoop.

7. A device according to claim 1 wherein said fastening element comprises a substantially cylindrical ring, said ring having an exterior surface with at least one substantially rigid tab which has a base end, a free end, and which extends outwardly in an inclined manner to the radial direction from said base end at said exterior surface to said free end of the tab, said free end trailing said base end when said driving component is turned in said first rotary direction; and said driving component comprises a substantially cylindrical hoop having a cylindrical interior surface having at least one stop, said stop arranged to receive and block the free end of said tab when said hoop is rotated in said first rotary direction.

8. A device according to claim 7 wherein said tab is adapted to break above a predetermined value of tightening torque.

9. A device according to claim 7 wherein said tab is one of a plurality of tabs spaced around a circumference of said exterior surface of said cylindrical ring and said stop is one of a plurality of stops spaced around a circumference of said interior surface of said hoop.

10. A device according to claim 5 wherein said tabs are elongated in a direction parallel to an axis of said hoop.

11. A device according to claim 9 wherein said tabs are elongated in a direction parallel to an axis of said hoop.

* * * * *